US006827617B2

(12) United States Patent
Metrot

(10) Patent No.: US 6,827,617 B2
(45) **Date of Patent: *Dec. 7, 2004**

(54) HOLLOW GLIDING BOARD WITH INERTIAL MASS

(75) Inventor: Eric Metrot, Bicton (AU)

(73) Assignee: Salomon S.A., Metz-Tessy (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/777,065

(22) Filed: Feb. 13, 2004

(65) Prior Publication Data

US 2004/0161987 A1 Aug. 19, 2004

Related U.S. Application Data

(63) Continuation of application No. 10/321,392, filed on Dec. 18, 2002, now Pat. No. 6,692,321.

(30) Foreign Application Priority Data

Dec. 19, 2001 (FR) ..... 01 16966

(51) Int. Cl.[7] ..... B63B 35/79
(52) U.S. Cl. ..... 441/74; 114/39.14

(58) Field of Search ..... 441/357, 39.14, 441/65, 68, 74, 79

(56) References Cited

U.S. PATENT DOCUMENTS

| | | | | |
|---|---|---|---|---|
| 3,123,845 | A | 3/1964 | Girden | 441/65 |
| 3,514,798 | A | 6/1970 | Ellis | 9/310 |
| 4,923,427 | A | 5/1990 | Roland | 446/153 |
| 5,514,016 | A | 5/1996 | Larson | 441/6 |
| 5,582,529 | A | 12/1996 | Montgomery | 441/74 |
| 6,669,519 | B2 | 12/2003 | Metrot | 441/65 |
| 6,692,321 | B2 * | 2/2004 | Metrot | 441/74 |
| 2002/0151233 | A1 | 10/2002 | Renard et al. | |

FOREIGN PATENT DOCUMENTS

| | | |
|---|---|---|
| DE | 2935529 | 3/1981 |
| DE | 3040792 | 8/1982 |

* cited by examiner

*Primary Examiner*—Sherman Basinger
(74) *Attorney, Agent, or Firm*—Greenblum & Bernstein, P.L.C.

(57) ABSTRACT

A hollow gliding board having an outer shell that demarcates at least one inner cavity, and having at least one inertial mass.

2 Claims, 3 Drawing Sheets

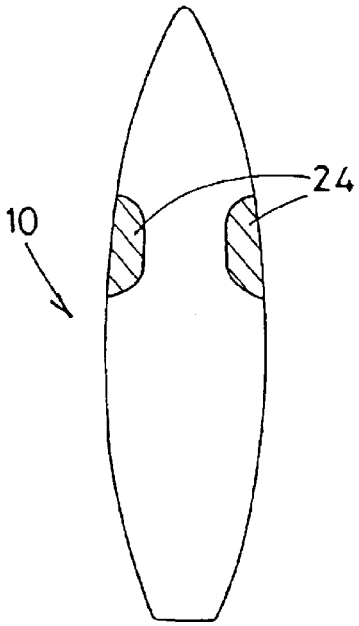
FIG.1
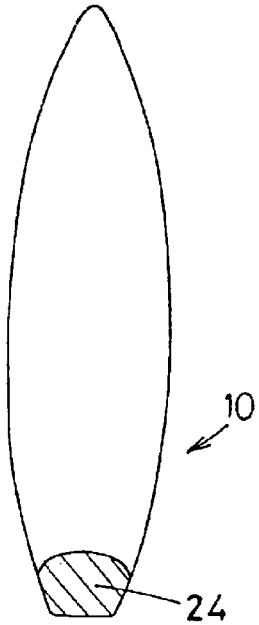
FIG.2
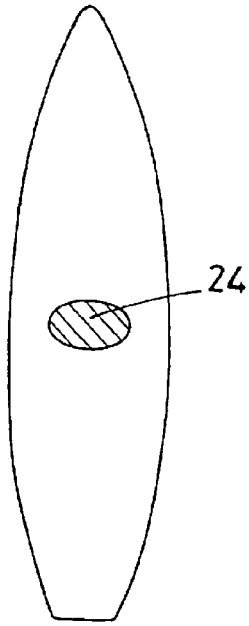
FIG.3
FIG.4
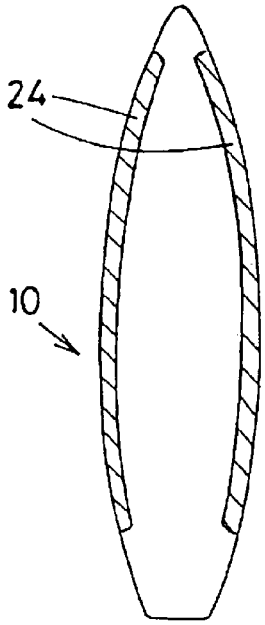
FIG.5
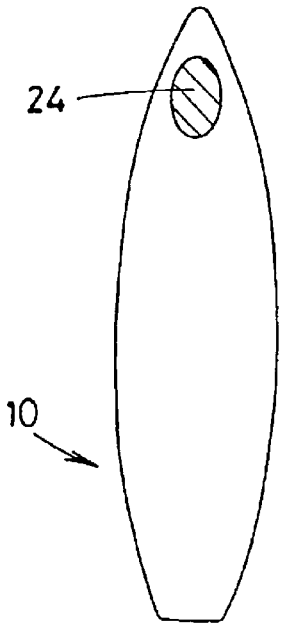

HOLLOW GLIDING BOARD WITH INERTIAL MASS

CROSS-REFERENCE TO RELATED APPLICATIONS

This application is a continuation of U.S. patent application Ser. No. 10/321,392, filed on Dec. 18, 2002, now U.S. Pat. No. 6,692,321, issued on Feb. 17, 2004, the disclosure of which is hereby incorporated by reference thereto in its entirety, and the priority of which is hereby claimed under 35 U.S.C. §120.

This application is based upon French Patent Application No. 01.16966, filed Dec. 19, 2001, the disclosure of which is hereby incorporated by reference thereto in its entirety, and the priority of which is hereby claimed under 35 U.S.C. §119.

BACKGROUND OF THE INVENTION

1. Field of the Invention

The invention relates to a hollow gliding board. The invention can be implemented particularly for manufacturing boards for gliding on water, such as surfboards.

2. Description of Background and Relevant Information

Gliding boards are generally solid objects, even when they are floats that must have a weight/volume ratio that is less than that of water. In order to obtain a lightweight board, one generally uses a composite manufacturing technology in which the board has an inner core formed of a light material and covered with a rigid outer material, giving the board its form and its rigidity.

To obtain even lighter boards, it is known to use technologies whereby the board obtained is hollow.

Such boards are normally much lighter than conventional boards, which has numerous advantages and allows using in particular a quicker style for steering the board. With this new steering style, the user requires a new type of dynamic behavior from the board.

SUMMARY OF THE INVENTION

To this end, the invention proposes a hollow gliding board having an outer shell that demarcates at least one inner cavity, and that includes at least one inertial mass.

BRIEF DESCRIPTION OF DRAWINGS

The invention will be better understood from the following description, with references to the attached drawings related thereto, and in which:

FIGS. 1–5 show, in a schematic top view, various possible zones for positioning the mass(es) in order to improve the dynamic behavior of the board;

DETAILED DESCRIPTION OF THE INVENTION

Figure 6:
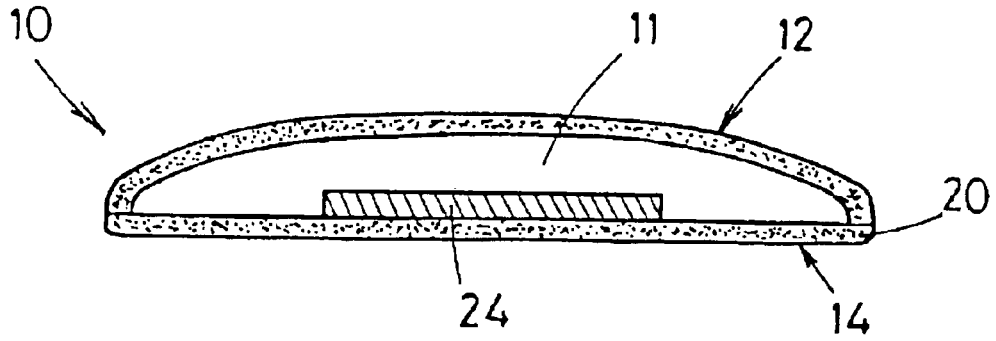
FIGS. 6–9 show, in a transverse cross-sectional plane, four embodiments for integrating one or several masses in a hollow float.

The following description of the invention relates more particularly to a float for a surfboard, but it could be embodied in other hollow gliding boards.

FIGS. 1–5 are top views that schematically show surfboard floats 10 on which are shown various possible zones 24 for positioning mass(es) adapted to modify the inertia and therefore the dynamic behavior of the board on water.

These zones have been determined more particularly for an entirely hollow board, i.e., a board 10 whose shell demarcates an inner cavity 11 that extends almost over the entire length and almost over the entire width of the board. As shown in more detail in FIGS. 6–10, such a board 10 can be constructed, for example, by assembling two half-shells 12, 14 together by gluing. Each half-shell 12, 14 is formed, for example, of a sandwich material having two outer skins 16, each of which is composed of layers of fabric made of fibers impregnated with a thermosetting resin, both skins 16 surrounding a core 18 made of a very light material, such as foam, or a honeycomb material. Each half-shell has a thickness on the order of a centimeter and is shaped in a mold so as to assume the shape of the deck 12 and of the hull 14, respectively, of the float. The two half-shells are assembled by a glue line along the plane of their parting line 20 that follows the peripheral edge of the board. In a known manner, the board thus constructed can have at least one stiffener, particularly a longitudinal stiffener 22 made in the form of a vertical partition that extends in the cavity 11 along the central longitudinal axis of the board by connecting the two half-shells 12, 14 together. A board 10 that is constructed according to this principle is described, for example, in U.S. Pat. No. 3,514,798.

Compared to a conventional construction of a solid board having a foam core surrounded by an outer fabric layer made of resin-impregnated fibers, a hollow construction allows going from a weight of approximately 3 kg to a weight of approximately 2 kg for a surfboard with the same form and having equivalent or greater mechanical properties. This reduction in weight, which can be greater than 30%, allows radically changing the behavior of the board on water, and translates particularly unto a greater speed and a greater quickness of the board. Nevertheless, in certain wave conditions, and to perform certain maneuvers, it has been noted that a hollow board provided with judiciously positioned masses could yield even better results.

FIG. 1 shows the possibility of longitudinally arranging two inertial masses 24 on the sides of the float, in the area of the middle point of the float or slightly in front of it. With this configuration, one substantially increases the moment of inertia in rotation about the longitudinal axis of the board. An optimal result is obtained by using two masses, each one having a weight less than 100 grams, preferably on the order of 50 grams. One can see, therefore, that an overall weight largely less than that of a conventional surfboard is kept. The light addition of weight does not penalize the qualities of speed and handling of the hollow board, but the increase of inertia in rolling allows a better control of the edge setting, and therefore a better control of the board in turns.

FIG. 2 shows the possibility of arranging a mass 24 in a zone located near the rear end of the board, which zone can go up to the support zone for the rear foot of the surfer. By arranging a mass in this zone, the board gains stability but has a tendency to lose speed.

FIG. 3 shows the possibility of arranging a mass 24 in the zone corresponding to the support zone for the front foot of the surfer, that is, beneath the surface area of the board on which the front foot of the surfer is supported. This zone corresponds substantially to the zone of the center of gravity of the board. Here, the mass has a weight less than 200 grams and, in a preferred, but non-limiting example, between 100 and 150 grams. With this position of the mass, the board is slightly less quick than a board without a mass, which can facilitate the control of the board in certain conditions. In addition, the increase in weight and, therefore, of inertia, allows the board to more easily keep its speed at the end of a maneuver.

Another possibility, shown in FIG. 4, includes arranging an elongated inertia mass 24 distributed over a portion at least of the length of each of the edges of the board. In the extreme, the mass 24 can thus extend over the entire periphery of the board. The overall mass of the masses thus distributed must remain relatively low, and it will therefore be advantageous to use a foam cord as a mass. Advantageously, one can provide that the assembly of the two half-shells 12, 14 be obtained by means of an adhesive resin foam, and that the peripheral mass 24 be made of the same material, possibly during the same operation, by making it so that the glue line "overflows" inwardly toward the inner cavity 11 of the board.

FIG. 5 shows that it is also possible to arrange the mass 24 in a front zone of the board. This possibility can be used particularly for boards that are relatively lengthy and adapted to surfboarding in high waves.

Depending on the results sought, one can be led to determine other preferred positions for the mass(es). One can also combine several mass positions, particularly several of the positions described hereinabove.

In FIGS. 6–10, various embodiments for constructing these masses are shown.

As shown in FIG. 6, the mass 24 can be constituted of a block of material affixed to one of the surfaces of the inner cavity 11. The material used can be a dense material, for example, a resin block, in which case the mass 24 has a small size, and the addition of mass will then be completely concentrated in its horizontal positioning in the plane of the board as well as along the vertical direction, in the direction of the thickness of the board. Conversely, the mass can be constituted of a non-dense material, such as a block of foam, in which case the size of the mass will be greater. In the example of FIG. 6, the mass does not extend the full height between the deck and the hull, and it is therefore possible to affix it either on the side of the deck 12, or on the side of the hull 14 (as shown). The choice between the different positionings will affect the behavior of the board.

Figure 7:
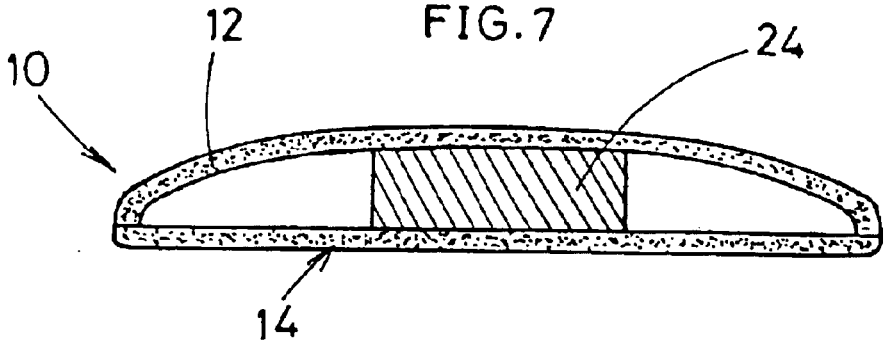

On the contrary, in the example of FIG. 7, the mass 24 extends over the entire height of the inner cavity, and it can form, in addition to its role of modifying the inertia of the board, a reinforcement between the deck 12 and the hull 14 to limit the creation of recesses. In this case, given the limited mass of the weight, the material used will preferably be a foam or a honeycomb material. This type of embodiment will be used, for example, for the thinnest boards, or when the mass 24 is arranged in a thin zone of the board, as is the case, for instance, in the embodiments of FIGS. 2 and 5.

Figure 8:
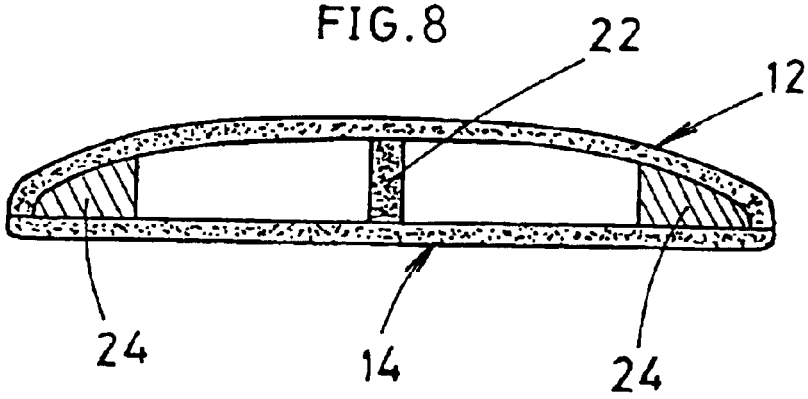

In the example of FIG. 8, the board is of the type having an inner longitudinal stiffener 22, shown as extending between the upper inner surface of the outer shell of the board and the lower inner surface of the outer shell of the board, and the masses 24 are arranged in the vicinity of the floats, as in the examples of embodiment of FIGS. 1 and 4. Here, each of the masses can be made, for example, from a rigid block of foam that is adequately shaped, or it can be a block of foam that is allowed to expand inside of the board at the time of assembly of the two half-shells 12, 14.

Figure 9:
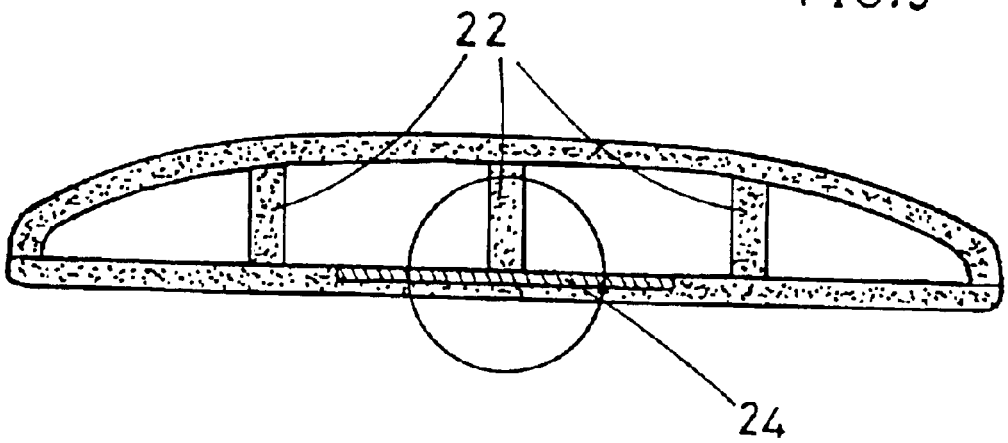
Figure 10:
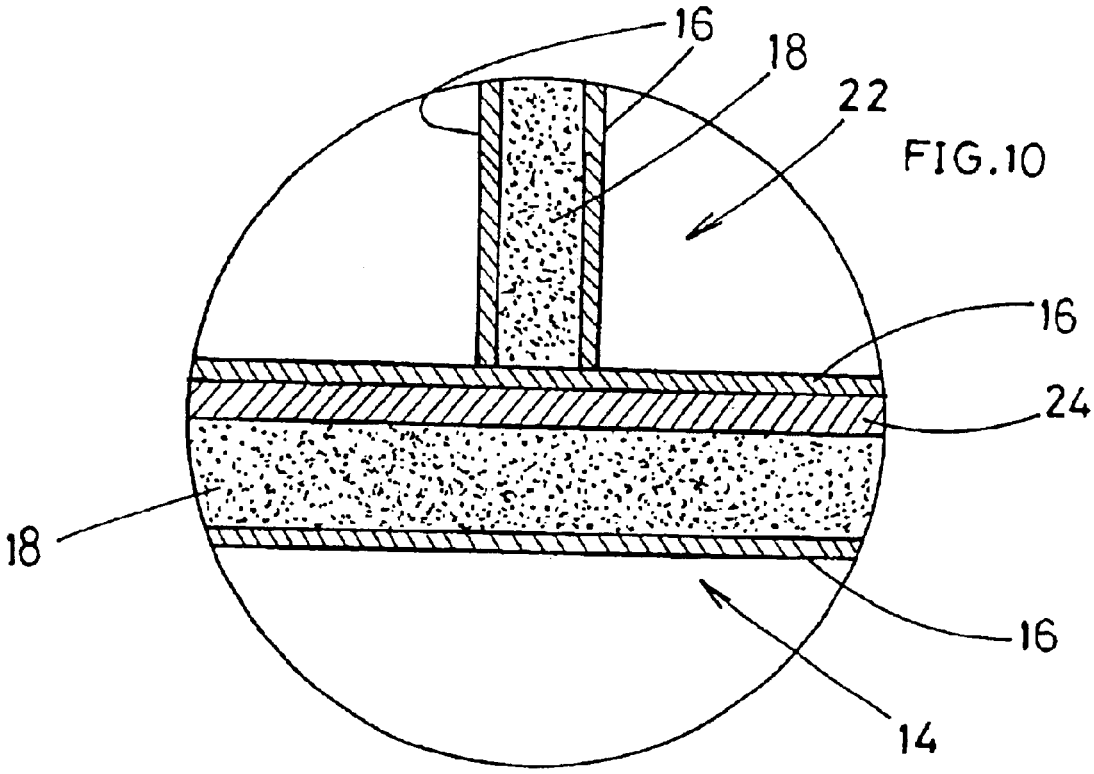
FIG. 10 is an enlarged view of a detail of FIG. 9.

In the example of FIG. 9, in which one can see that the board has three longitudinal stiffeners 22, the mass 24 is directly integrated in the structure of one of the half-shells. In this case, as shown in the detail of FIG. 10, the half-shell has a sandwich structure and the mass 24 is integrated in the core 18, between the two skins 16 of the sandwich. The mass 24 can be formed, for example, of a sheet of dense material, possibly a metallic sheet. In the example shown, the mass is located on the inner side of the core that is the closest to the cavity 11. One can also provide that the mass be arranged on the outer side of the core, or yet that the mass extend over the entire thickness between the two skins 16. This type of construction can also be provided on the hull 14 as well as on the deck 12, and the mass 24 can be arranged transversely at the center or, on the contrary, on the sides of the board.

Other embodiments are possible for constructing the mass(es).

In all of the cases, the mass according to the invention is not to be confused with a reinforcement or a conventional stiffener, from which it is distinguished, in addition to its function, by its positioning and by its weight that generally will not exceed 200 grams. This relatively light weight, compared to the weight of a hollow surfboard of approximately 2 kg, as mentioned above, then, results in a ratio of total weight of the inertial mass(es) to surfboard weight (considered without such mass(es)) of less than 200 grams to approximately 2 kg, or stated another way, a ratio of less than approximately 10%. The gliding board thus proposed is therefore original, particularly in the sense that the invention allows substantially modifying the behavior of a hollow board, by conserving a very large portion of the specific qualities due to the lightness of these hollow boards.

What is claimed is:

1. A hollow surfboard comprising:

an outer shell having at least one inner cavity, a support zone for a front foot of a surfer and a support zone for a rear foot of a surfer, both of said support zones comprising upwardly facing surfaces of the surfboard adapted to be directly beneath the front foot and the rear foot of the surfer;

at least one inertial mass;

the inner cavity having a height;

the mass extending vertically over the height of the inner cavity of the surfboard.

2. A hollow surfboard comprising:

an outer shell having at least one inner cavity, a support zone for a front foot of a surfer and a support zone for a rear foot of a surfer;

at least two inertial masses symmetrically arranged on opposite sides of a longitudinal median plane of the surfboard;

the inner cavity having a height;

each of the two masses extending vertically over the height of the inner cavity of the surfboard.

* * * * *